US005338405A

United States Patent [19]

Patt et al.

[11] Patent Number: 5,338,405

[45] Date of Patent: Aug. 16, 1994

[54] PRODUCTION OF FIBER PULP BY IMPREGNATING THE LIGNOCELLULOSIC MATERIAL WITH AN AQUEOUS ALCOHOLIC $SO_2$ SOLUTION PRIOR TO DEFIBRATION

[75] Inventors: Rudolf Patt, Reinbek; Georg Rachor, Grossostheim, both of Fed. Rep. of Germany

[73] Assignee: Stora Feldmühle Aktiengesellschaft, Düsseldorf, Fed. Rep. of Germany

[21] Appl. No.: 842,365

[22] PCT Filed: Sep. 25, 1990

[86] PCT No.: PCT/EP90/01622

§ 371 Date: May 18, 1992

§ 102(e) Date: May 18, 1992

[87] PCT Pub. No.: WO91/05102

PCT Pub. Date: Apr. 18, 1991

[30] Foreign Application Priority Data

Sep. 28, 1989 [DE] Fed. Rep. of Germany ..... 3932347

[51] Int. Cl.[5] ..... D21B 1/16

[52] U.S. Cl. ..... 162/25; 12/26; 12/77; 12/83

[58] Field of Search ..... 162/77, 83, 86, 90, 162/24, 25, 26, 28

[56] References Cited

U.S. PATENT DOCUMENTS

| | | | |
|---|---|---|---|
| 1,951,167 | 3/1934 | Respess et al. | 162/24 |
| 2,060,068 | 10/1936 | Groombridge | 162/17 |
| 3,585,104 | 7/1968 | Kleinert | 162/17 |
| 4,211,605 | 7/1980 | Saxton et al. | 162/83 |
| 4,767,499 | 8/1988 | Simonson et al. | 162/83 |

*Primary Examiner*—W. Gary Jones
*Assistant Examiner*—Dean T. Nguyen
*Attorney, Agent, or Firm*—Felfe & Lynch

[57] ABSTRACT

In a process for manufacturing chemo-mechanical and-/or chemothermal-mechanical wood pulps, raw materials containing lignocellulose, such as wood shavings, wood chips, pre-ground wood or sawdust, are first impregnated with an aqueous alcoholic $SO_2$ solution and then heated to a temperature between 50° and 170° C. for a period of 1 to 300 minutes. The wood shavings are then ground to the desired degree of fineness in a defibrinating device. The process makes it possible to achieve up to 50% reduction in grinding energy in comparison with known chemothermal-mechanical processes.

14 Claims, No Drawings

PRODUCTION OF FIBER PULP BY IMPREGNATING THE LIGNOCELLULOSIC MATERIAL WITH AN AQUEOUS ALCOHOLIC $SO_2$ SOLUTION PRIOR TO DEFIBRATION

FIELD OF THE INVENTION

The invention relates to a process according to the introductory part of claim 1 for the manufacture of chemimechanical and/or chemithermo-mechanical wood products from raw materials containing wood cellulose, such as wood particles, wood chips, raw wood fibers or sawdust.

BACKGROUND OF THE INVENTION

The manufacture of wood materials in refiners under optimal conditions permits better qualities than does stone grinding production. But thermal treatment or thermal and chemical treatment of the wood is required prior to defibration. The purpose of such preliminary treatment is to soften the lignin, thereby reducing the energy needed for the release of the fibers from the tissue and producing breaking points in the area of the primary wall and S1. The resultant fiber surfaces are rich in carbohydrate and therefore are well qualified for the formation of hydrogen bridges between the surfaces of these fibers. The temperatures to be applied in the preliminary thermal treatment are between 125° and 150° C. In the case of a treatment time of a few minutes, the above-mentioned aim of lignin plastification is to be reached, but it is not to be so extensive as to result in separation of the fibers in the middle lamella area, which would result in an intact fiber but it would have a hydrophobic lignin coating on the surface. Higher temperatures or longer treatment also have the disadvantage that the lignin structure is changed by condensation reactions and the fibers darken considerably.

By sulfonating the wood at the breaking points a controlled defibration of the wood is achieved, loss of whiteness is prevented and a more hydrophilic lignin is produced at the later fiber surface. The production of more flexible fibers is to be considered as an additional positive aspect of sulfonation.

The energy needs for the isolation of fibers from the wood tissue are diminished by a thermal or chemical pretreatment of the wood. For the production of high-quality fiber materials for paper and linerboard production, however, they have to be additionally defibrillated. In this case wall layers or fibrils are stripped from the surface of the fibers by mechanical action, thereby increasing the specific surface area of the fibers and thus improving their bonding capacity and their flexibility. Such processes are described extensively in "Pulp and Paper Manufacture," vol. 2, Mechanical Pulping, Tappi, Atlanta 1987.

In comparison to the stone grinding process the power requirements in all refiner wood pulp processes are significantly higher. In the stone grinding process the defibering energy is delivered directly to the wood layer in direct contact with the stone surface. In refiner processes the energy transfer is less controlled, since energy is consumed in the acceleration of the pulp, in the rubbing of the wood particles on one another and on the disks, in the forming of the particles and in the fluid friction. In the stone grinding process the forces are always applied transversely of the fiber direction, where the wood has less strength. Since the fibers of the chips of wood in the refiner are not always aligned parallel to the centrifugal force, the energy expenditure on defibration is in this case higher. The thermal and chemical pretreatment can lower the energy needed for releasing the fibers from the wood tissue, but the total energy required for the production of a more or less thoroughly defibrillated wood pulp does not diminish, since the fibers have been made more flexible by the treatment, and can escape the action of the grinding segments of the refiner, so that a more controlled defibrillation becomes possible, but it requires more stressing and relieving processes.

If approximately 1500 kWh/t has to be expended for a high-quality softwood stoneground pulp, thermomechanical pulp (TMP) requires about 2000 and chemithermo-mechanical pulp (CTMP) 2500 kWh/t.

For the production of high-quality wood pulps, a sulfonation of the lignin is necessary, as already mentioned. This is usually performed by using sodium sulfite in an alkaline medium, since a swelling of the fiber also takes place simultaneously, which creates good conditions for the defibration that follows. A sulfonation reaction also takes place in the acid pH range, and the lower the pH is, the faster it goes. However, competing condensation reactions of the lignin are also promoted by low pH values. Lignosulfonates with a high degree of sulfonation are insoluble in water and therefore reduce the fiber yield. On the other hand, acids attack the carbohydrates, depolymerize them and lead to weakening of the fiber bond.

The high energy requirements, especially of the CTMP pulps, limits their production to countries with low energy prices. Future developments in the field of wood pulp manufacture is therefore dependent substantially on the energy requirements of the process. A definite reduction of the energy input appears to be essential.

OBJECTS OF THE INVENTION

It is therefore the purpose of the development of an energy-efficient wood pulp manufacturing process to find conditions which will permit a controlled sulfonation to a slight degree, prevent condensation of the lignin, avoid losses of yield, and reduce the amount of energy required for the defibration of the wood and for the defibrillation of the resultant fibers. For the environmental safety of such a process it would also be very advantageous if the chemicals used in treatment could be completely or at least largely recoverable. This purpose is accomplished by the specific part of claim 1. Additional advantageous developments are stated in the secondary claims.

DESCRIPTION OF THE INVENTION

In J. Jackson et al., "Chemithermomechanical pulp production and end-uses in Scandinavia," Tappi Journal, vol. 85, No. 2, February '85, Easton, U.S., pages 64–68, CTMP/CMP processes in accordance with the generic part of claim 1 are disclosed.

The use of aqueous acid digesting solutions of aliphatic, water-miscible alcohols and sulfur dioxide in the manufacture of paper has long been known from U.S. Pat. No. 2,060,068. Schorning has also reported on sulfite digestion without bases with the use of methanol for the manufacture of wood pulps in "Faserforschung und Textiltechnik 12, 487 to 494, 1957." The method described has not been employed in practice in spite of the described advantages. Although the Schorning process was published back in 1956, experiments in cellulose-alcohol digestion were again taken up in the mid-70's, and only then did they lead to partial success, as is proven by DE-A-32 17 767.

On the basis of the results reported by Schorning, the aim of all studies conducted was to discover a formula for cooking wood pulp that would offer a highly deligninized cellulose for further processing to synthetic fiber cellulose. The yields of the pulping processes found to be good ranged from 40 to 50 wt. %. Pulps of higher yields were discarded. No proof that such pulps might also be used for paper manufacturing purposes is to be found in this literature reference. In particular, there is no information on strength tests that might have permitted any hint as to the suitability of such pulps for papermaking purposes.

If milder temperature conditions and/or shorter reaction times are selected, the lignin can be surprisingly sulfonated without great losses of yield and without the occurrence of the unwanted condensation reactions. The power needed in the subsequent defibration of the wood can then easily be reduced to about 50%, depending on the conditions of treatment, and the resultant wood pulps have excellent technological qualities. At the same time the specific grind is selected in a range from 1200 to 1900 kWh/t depending on the desired degree of fineness.

The use of the acid system, of aliphatic alcohol/water/$SO_2$ not only succeeds in sulfonating lignin, wherein the alcohol serves as the base, but also the impregnation is improved by the presence of the alcohol, condensation reactions in the lignin are suppressed, and resin acids and fatty acids are dissolved. The alcohol additionally improves the solubility of the sulfur dioxide in the water. This system is active at temperatures even lower than 100° C., but higher temperatures can also be used. It is to be noted, however, that the sulfonation is conducted only until the lignin softens at the desired breaking points between the primary wall and S1 of the fiber bond. Further sulfonation results in losses of yield and fiber damage due to the loss of the lignin that is dissolved out.

An important advantage in this kind of pulping is that the chemicals used can easily be recovered. The alcohol can be removed quantitatively, while in the case of sulfur dioxide only the part that does not react with the wood is recyclable. In comparison to neutral or alkaline sulfite systems containing bases, with their more complicated recovery, this is an important advantage.

The aqueous cooking liquor used in the process of the invention contains 10 to 70% by volume of aliphatic, water-miscible alcohols and 1.0 to 100.0 g/l of sulfur dioxide. The pH of the cooking liquors is between 1.0 and 2.0 depending on the $SO_2$ content. The wood particles are suspended in this liquor, selecting a ratio of 1:3 to 1:6, i.e., 1 kg OD of wood particles are suspended in 3 to 6 kg of liquor. In selecting the bath ratio, the wood particle moisture which lowers the concentration of the bath liquor must be taken into account. The percentage of sulfur dioxide contained in the bath liquor depends on the percentage by volume of the alcohol content. Other criteria for the selection of the sulfur dioxide concentration are the desired degree of lignin sulfonation according to the desired yield, and the temperature and time selected for the lignin sulfonation. After the wood particles are imbibed with the cooking liquor they are heated to 50° to 170° C. to start the lignin sulfonation reaction. After the particles are imbibed excess cooking liquor can be removed, especially when the lignin sulfonation is to be performed in the vapor phase. The heating can be performed indirectly by circulating the cooking liquor through a heat exchanger or directly by the introduction of steam.

The end temperature is chosen again in accordance with the desired yield, the concentration of the cooking liquor and the cooking time. If the cooking time is to be short a higher end temperature can be preselected and vice versa. If the end temperature is to be over 70° C., it is necessary to perform the reaction in a pressure cooker to prevent premature outgassing of the alcohol and sulfur dioxide.

After the preselected end temperature is reached it is maintained for a holding period of 1 to 300 minutes. At low end temperatures long holding periods are necessary, and vice versa, again according to the desired yield.

At the end of the holding period, first the mixture of alcohol, water vapor and unconsumed sulfur dioxide gas can be withdrawn and subject to further processing, e.g., by condensation. Alcohol and sulfur dioxide still present in the liquid can also be vaporized by lowering the pressure or injecting steam, and can be recovered. The recovery of the alcohol and unconsumed sulfur dioxide, however, can also be performed in a heat recovery apparatus with condensation stage, known in itself, following the defibration system.

After that, the wood chips are delivered by conveying systems known in themselves to a known defibrator, such as a disk refiner, and mechanically defibered. If desired, the defibrator can be preceded by a wood particle washing apparatus. A preselected degree of fineness of the chips to be defibrated is achieved by controlling the throughput per unit time and the energy absorption of the driver of the disk refiner in kilowatt-hours per metric ton of fiber.

The alcohols used in the cook liquor, are preferably those with straight or branched chains, individually or in mixtures.

In order to assure a complete and technically simple recovery of the alcohols after the lignin sulfonation has ended, alcohols are preferred whose boiling point at standard pressure is less than 100° C. These alcohols include methanol, ethanol, propanol, isopropanol and tertiary butyl alcohol. On account of its great availability and economical price, methanol is preferred.

The ratio of admixture between water and alcohol can vary within wide limits, but preferably the alcohol content is between 20 and 50 vol.-%, especially between 20 and 40 vol.-%.

Since the rate of lignin sulfonation depends on the sulfur dioxide concentration, high concentrations are basically desirable. However, at elevated temperature during the holding period, high concentrations can lead to undesirable losses of yield, so that a sulfur dioxide content in the cooking liquor of 5 to 40 g/l is preferred.

The stated end temperature range during the holding period can be freely chosen within the stated limits, in accordance with the length of the period and the concentration of the cooking liquor. Higher temperatures, however, require a greater input of heat as well as special design measures in the reaction vessel on account of the increase in pressure that they cause. Consequently, it is preferred that the cooking liquor containing the wood particles be heated to a temperature of 80° to 120° C. If alcohols with a boiling point close to 100° C. are used, a temperature of 100° to 120° C. is selected.

The holding time at the end temperature affects, on the one hand, the degree of the yield, and on the other hand it will depend on the capacity of the reaction vessel and the mass stream of cooking liquor and wood chips that is to be passed through it. Therefore a holding period at end temperature of 2 to 120 minutes is preferred, especially in continuous processes.

If provision for energy reduction in the manufacture of chemithermo-mechanical wood pulps by impregnation with an alcohol/water/sulfur dioxide liquor is to be combined with a very gentle defibration, the actual impregnation can be preceded by a treatment wherein the wood particles are pretreated with an aqueous alcoholic solution containing a neutral and/or alkaline sodium compound.

Such sodium compounds can consist of sodium sulfite and/or sodium hydroxide and/or sodium carbonate, the solution containing preferably a concentration of 1 to 10 g/l total alkali, reckoned as NaOH.

The purpose of these sodium compounds is to buffer the organic acids, such as formic and acetic acid, which in the course of the actual lignin sulfonation reaction form from the wood during the holding period at end temperature, to prevent lignin condensation due to an excessively low pH, and to promote the swelling of the wood.

Another advantage of adding the sodium compounds is the preservation of the white content of the wood particles being defibered, especially by the addition of sodium sulfite.

The treatment of the wood particles with an aqueous solution containing a sodium compounds can also be performed in the reaction vessel after the lignin sulfonation reaction and after the alcohol and sulfur dioxide have been driven out and withdrawn from the remaining cook liquor. For this purpose the wood particles are first separated from the remaining cook liquor by means of apparatus known in themselves, and then treated with a solution containing the sodium compound, at a temperature of 20° to 150° C. A solution containing 1 to 10 g/l of sodium sulfite, sodium hydroxide or sodium carbonate, reckoned as NaOH, alone or in mixture, is preferred. In this way it is also possible to have a positive influence on the technological properties of the wood pulp being produced.

The present process can also be applied to fiber that has already been defibered mechanically, such as the "sauerkraut" waste produced in the production of wood flour.

The process according to the invention will be further explained in the following examples.

EXAMPLE 1

Spruce chips are treated at 120° C. for 10 minutes with a 40:60 vol.-% methanol/water mixture containing 12.5 g/l $SO_2$. The bath ratio is 1:4. After the treatment period the methanol as well as the consumed $SO_2$ are recovered in the gas phase and the wood is defibered in a refiner. In a grind to 70° SR, the grinding energy consumption amounts to only 1400 kWh/t, while sprucewood chips pretreated with 25 g/l of $Na_2SO_3$ required 2500 kWh/t to achieve the same fineness. The energy saving thus amounts to 44%.

The yield amounts to 95%, and the pulp has the following technical qualities:

| | |
|---|---|
| Breaking length | 3,280 m |
| Tear propagation strength (Brecht/Imset) | 1.04 J/m |
| Specific volume | 2.30 $cm^3/g$ |
| Light scattering coefficent per SCAN C27:69 | 42.5 $m^2/kg$ |

EXAMPLE 2

Spruce chips are first treated for 15 minutes at 100° C. with a methanol/water mixture containing 5 g/l of $Na_2SO_3$, and then an aqueous $SO_2$ solution containing 50.0 g/l is added and the chips are pulped for 60 minutes at 100° C. The bath ratio after adding the $SO_2$ solution is 1:4. After recovery of the gaseous pulping chemicals the chips are defibered in the refiner to a fineness of 70° SR. The energy demand amounts to 1,850 kwH/t, which signifies a saving of 25% in comparison to a standard CTMP.

The yield is 96%, the fiber has the following technical qualities at 70° SR:

| | |
|---|---|
| Breaking length | 4,070 m |
| Tear propagation strength (Brecht/Imset) | 1.23 J/m |
| Specific volume | 2.22 $cm^3/g$ |
| Light scattering coefficient per SCAN c27:69 | 46.7 $m^2/kg$ |

EXAMPLE 3

A wood pulp defibered in the refiner without pretreatment, to a fineness of 15° SR is treated for 10 minutes at 100° C. with the methanol/water/sulfur dioxide liquor described in Example 1 and then additionally ground in a Jokro mill under standard conditions. To achieve a fineness of 70° SR, 6,750 revolutions were needed. The untreated reference pulp required 15,750 revolutions to achieve a fineness of 63° SR.

EXAMPLE 4

Spruce wood chips are treated at 600° C. for 60 minutes with a methanol/water mixture of 30:70 vol.-%, containing 50 g/l of sulfur dioxide. After the treatment the methanol and the unconsumed sulfur dioxide are recovered and the chips are defibered in a refiner. 1,390 kWh/t are required for the achievement of a fineness of 77° SR.

The yield is 92.0%, and the fiber has the following technical qualities:

| | |
|---|---|
| Breaking length | 4,070 m |
| Tear propagation strength (Brecht/Imset) | 0.9 J/m |
| Specific volume | 2.03 $cm^3/g$ |
| Light scattering coefficient per SCAN C27:69 | 39.9 $m^2/kg$ |

EXAMPLE 5

Spruce wood chips are steamed for 20 minutes and put into a 50:50 vol.-% methanol/water mixture containing 100 g/l of $SO_2$. After an impregnation period of 30 minutes the excess liquor is drawn off. The chips impregnated in this manner are treated in a defibrator for 5 minutes with 150° C. steam and then defibered under pressure. The grinding energy to achieve a fineness of 68° SR is about 1,510 kWh/t.

The fiber material thus produced has the following technical qualities:

| | |
|---|---|
| Breaking length | 4,130 m |
| Tear propagation strength (Brecht/Imset) | 1.02 J/m |
| Specific volume | 2.28 $cm^3/g$ |
| Light scattering coefficient per SCAN c27:69 | 41.5 $m^2kg$ |

EXAMPLE 6

An additional pulping test was performed in accordance with the invention with a methanol/sulfur dioxide liquor which contained 70 vol.-% of methanol and 23 g/l of $SO_2$, at a temperature of 160° C., for a cook time of 8 minutes. These chips were then defibered in a disk refiner.

The results of the technical tests are contained in Table 1, including the pumping parameters.

EXAMPLES 7 and 8, for comparison purposes

Pulping was performed on spruce wood chips in a manner similar to Schorning's with a methanol/$SO_2$ liquor containing 50 vol.-% of methanol and 55 g/l of $SO_2$, at a temperature of 130° C. during a cooking period of 205 minutes, Example 7, and 300 minutes, Example 8.

In the Schorning tests the yield, the whiteness, the breaking length and the tear strength are surprisingly low. A pulp of this kind is absolutely unsuitable for papermaking. Also the very high splinter content—according to Schorning the pulp should be free of splinters—does not permit use for papermaking purposes.

| Example | | 6 | 7 | 8 |
|---|---|---|---|---|
| Temperature | °C. | 160 | 130 | 130 |
| Cooking Time | min | 8 | 205 | 300 |
| $SO_2$ Input | %/liter | 2.3 | 5.5 | 5.5 |
| | %/OD | 13.9 | 33.0 | 33.0 |
| Methanol content | vol.-% | 70 | 50 | 50 |
| Initial pH | — | 1.1 | 1.0 | 0.9 |
| Yield | % | 92.5 | 43.5 | 39.2 |
| Splinter content | % | 0.8 | 13.1 | 10.6 |
| Splinter-free Yield | % | 91.5 | 30.4 | 28.6 |
| Whiteness | % ISO | 61.6 | 22.8 | 19.0 |
| Residual Lignin Content | % | 22.2 | 7.8 | 7.4 |
| Kappa No. | — | 148 | 51.7 | 49.5 |
| Limiting Viscosity | dm/kg | — | 544 | 458 |
| Fineness | SR | 70 | 20 | 19 |
| Breaking Length | km | 4480 | 1970 | 1670 |
| Burst length | kPa | — | 50 | 40 |
| Breaking Strength | cN | 70.2 | 13.2 | 11.3 |

We claim:

1. In a process for the manufacture of chemimechanical or chemithermo-mechanical wood pulps from raw materials containing lignocellulose, for the manufacture of paper, pasteboard or liner board by mechanical comminution, sorting and homogenization of the raw materials containing lignocellulose, impregnation with a cooking liquor, cooking of the raw materials, defibration in one or more defibrating apparatus connected in series or parallel, and sorting of the fiber material produced, the improvement which comprises a) combining the raw materials containing lignocellulose with an aqueous acid cooking liquor with a pH of 1.0 to 2.0 containing:

aa) 10 to 70 volume % of aliphatic alcohols miscible with water, ab) 1.0 to 100 g/l of sulfur dioxide, b) starting the lignin sulfonation reaction by heating the mixture of a) to a temperature between 50° and 170° C.

c) maintaining the end temperature for a period of 1 to 300 minutes;

d) driving out and recovering the alcohol and the unconsumed sulfur dioxide, and e) shredding the lignocellulosic raw material into fibers of a preselected degree of fineness by means of a preselected specific grinding operation in the range from 1,200 to 1900 kwh/t of fiber and wherein the pulp yield is in the range of 92 to 96%.

2. Process according to claim 1, wherein the cooking liquor contains alcohols with straight or branched chains.

3. Process according to claim 1, wherein the boiling point of the alcohols at standard pressure is below 100° C.

4. Process according to claim 1, wherein the cooking liquor contains 20 to 50 volume % of aliphatic alcohols miscible with water.

5. Process according to claim 1, wherein the cooking liquor contains 20 to 40 volume % of aliphatic alcohols miscible with water.

6. Process according to claim 1, wherein the cooking liquor contains 5 to 40 g/l of dissolved $SO_2$.

7. Process according to claim 1, wherein the mixture of cooking liquor and raw material containing lignocellulose is heated to a temperature of 70° to 120° C.

8. Process according to claim 1, wherein the mixture of cooking liquor and raw material containing lignocellulose is heated to a temperature of 70° to 100° C.

9. Process according to claim 1, wherein the end temperature is sustained for a period of 2 to 120 min.

10. Process according to claim 1, wherein the lignocellulosic raw material is treated prior to mixture with the cooking liquor with an additional solution containing an aliphatic, water-miscible alcohol solution containing a neutral or alkaline sodium compound.

11. Process according to claim 10, wherein the additional solution contains sodium sulfite, sodium hydroxide, sodium carbonate or mixtures thereof in a proportion of 1 to 10 g/l total alkali, calculated as NaOH.

12. Process according to claim 1, wherein after the alcohol and $SO_2$ gas have been driven out and withdrawn, the lignocellulosic raw material is separated from the residual cooking liquor and treated with an aqueous solution of a neutral or alkaline sodium compound at a temperature of 20° to 150° C.

13. Process according to claim 12, wherein the solution for the after-treatment of the lignocellulosic raw material contains sodium sulfite, sodium hydroxide or sodium carbonate in a proportion of 1 to 10 g/l total alkali, calculated at NaOH.

14. Process according claim 1, wherein the lignocellulosic raw material is given a preliminary mechanical defibration to a coarse material before being combined with the cooking liquor.

* * * * *